US005092141A

United States Patent [19]

Quinn

[11] Patent Number: 5,092,141

[45] Date of Patent: Mar. 3, 1992

[54] ADDITIVE FLUID DISPENSER NOZZLE

[75] Inventor: William R. Quinn, Swampscott, Mass.

[73] Assignee: Raytheon Company, Lexington, Mass.

[21] Appl. No.: 725,939

[22] Filed: Jun. 27, 1991

Related U.S. Application Data

[63] Continuation of Ser. No. 609,058, Nov. 5, 1990, abandoned, which is a continuation of Ser. No. 458,219, Dec. 28, 1989, abandoned.

[51] Int. Cl.[5] ..... D06F 39/02; D06F 39/08

[52] U.S. Cl. ..... 68/17 R; 68/23.5; 68/207

[58] Field of Search ..... 68/17 R, 18 FA, 23.5, 68/207

[56] References Cited

U.S. PATENT DOCUMENTS

| | | | |
|---|---|---|---|
| 2,638,112 | 5/1953 | Shelton | 68/207 X |
| 2,899,814 | 8/1959 | Buechler | 68/17 R X |
| 3,020,741 | 2/1962 | Waldrop | 68/207 X |
| 3,035,431 | 5/1962 | Smith et al. | 68/17 R X |
| 3,066,520 | 12/1962 | Jennings | 68/18 FA X |
| 3,118,297 | 1/1964 | Olding | 68/17 R X |
| 3,170,314 | 2/1965 | Worst | 68/17 R X |
| 3,301,022 | 1/1967 | Low | 68/207 X |
| 3,335,584 | 8/1967 | Urban | 68/207 |
| 4,000,468 | 1/1977 | Schrage et al. | 68/207 X |
| 4,784,666 | 11/1988 | Brenner et al. | 8/137 |

FOREIGN PATENT DOCUMENTS

| | | | |
|---|---|---|---|
| 2214524 | 9/1989 | United Kingdom | 68/17 R |

*Primary Examiner*—Philip R. Coe

*Attorney, Agent, or Firm*—William R. Clark; Richard M. Sharkansky

[57] ABSTRACT

A clothes washing machine including a cabinet having an upper wall portion provided with a clothes receiving opening, an annular cowling within the cabinet and having an inner peripheral portion encircling the clothes receiving opening, the cowling having an annular midportion sloped radially downward to an outer peripheral portion of the cowling which is secured to a rim of a drain tub defining an open end thereof, the drain tub having rotatably supported therein a spin tub with an opening disposed within the open end portion of the drain tub and aligned with the clothes receiving opening, and a liquid soap dispensing system disposed within the cabinet and externally of the drain tub, the soap dispensing system comprising a multi-load reservoir of liquid soap connected hydraulically through a pump to a nozzle having a drain tube with a spout end portion adjacent the inner peripheral portion of the cowling and encircling a delivery tube which is disposed longitudinally and eccentrically within the drain tube, the delivery tube having an input end portion connected hydraulically to the pump and having an opposing spout end portion recessed axially within the spout end portion of the drain tube, the spout end portion of the delivery tube being conically shaped and having extended through a sloped wall portion thereof an outlet orifice which is aligned with a target aperture in the cowling overlooking the opening in the spin tub.

16 Claims, 2 Drawing Sheets

ADDITIVE FLUID DISPENSER NOZZLE

This application is a continuation of application Ser. No. 609,058 filed Nov. 5, 1990, which is a continuation of Ser. No. 458,219, filed Dec. 28, 1989, both now abandoned.

BACKGROUND OF THE INVENTION

1. Field of the Invention

This invention relates generally to automatic washing machines and is concerned more particularly with an automatic clothes washing machine having means for dispensing additive fluid from a multi-load reservoir thereof into a wash load for a particular operation of the wash cycle.

2. Discussion of the Prior Art

In the loading of an automatic washing machine, clothes generally are deposited through an access door into an open end of a perforated spin tub which is rotatably supported in a stationary drain tub within a cabinet. The washing machine may be cycled through a sequence of operations including a presoaking operation followed by a first liquid extraction, a washing operation followed by a second liquid extraction, a rinsing operation followed by a third liquid extraction, and a spin drying operation. For any of these operations, an additive fluid may be injected into the wash load to enhance the results of the associated operation.

Consequently, there has been developed in the prior art a number of additive dispensing means having respective housings disposed for holding additive liquids until released for a particular operation of the wash cycle. However, the housings of these prior art dispensing means generally are designed for mounting on the terminal end portion of an agitator post extending axially in the spin tub. Thus, each of these prior art dispensing means has a housing disposed in the open end of the spin tub which is adjacent the access door through which clothes are passed. As a result, clothes in the wash load, particularly delicate garments, for example, may be damaged by catching or snagging on the housing of a prior art dispensing means during loading or unloading of the washing machine.

Also, a prior art dispensing means of the described type may have a housing with an outlet aperture disposed over the wash load for releasing additive liquid directly into the spin tub. Consequently, after release of the additive liquid is completed, lingering droplets thereof may accumulate at the outlet aperture and drip into the spin tub at an inopportune time in the wash cycle. Thus, liquid soap in highly concentrated form or strong bleach, for examples, may fall from the outlet aperture of the housing onto particular articles of clothing in the wash load after the rinsing operation is completed. As a result, these particular articles of clothing receiving the substantially undiluted liquid additive may be damaged severely.

Moreover, a prior art dispensing means of the described type may depend upon rotation of the agitator post during a particular operation in the wash cycle for releasing the additive liquid from the housing. Thus, when the agitator post is rotated unidirectionally at relatively high speed, for example, the resulting centrifugal force acting on the additive liquid may be sufficient to cause the additive liquid to pass through the outlet aperture in the housing. As a result, the additive liquid may be delivered to the wash load as a spray having an output which varies erratically and which is difficult to calibrate. Consequently, it is difficult to determine with repetitive accuracy the amount of additive liquid required to enhance the results of the associated operation, as desired.

SUMMARY OF THE INVENTION

These and other disadvantages of the prior art are overcome by this invention providing a clothes washing machine with a cabinet having therein an additive fluid dispensing system including liquid ejector means comprising a nozzle which may be connected hydraulically through a pump to a reservoir of additive liquid. The nozzle is recessed laterally from a clothes receiving opening in an access end wall of the cabinet extending protectively over the nozzle. Thus, the nozzle is disposed for preventing clothes snagging thereon when being passed through the clothes receiving opening.

The nozzle is supported in substantially radial orientation on an annular cowling having an outer peripheral portion which is secured supportively to an annular rim of a stationary drain tub defining a drain tub opening disposed in a plane adjacent the cowling. From the outer peripheral portion of the cowling, the nozzle and the cowling extend radially inward of the drain tub opening and are sloped at respective similar divergent angles with respect to the plane of the drain tub opening. Adjacent the clothes receiving opening, the cowling has an inner peripheral portion defining a cowling opening which is larger than the clothes receiving opening and is aligned therewith. Rotatably disposed in the drain tub is a spin tub having adjacent the drain tub opening a spin tub opening which is larger than the cowling opening and aligned with the clothes receiving opening. The nozzle has an output end portion aligned with a target aperture in the cowling overlooking the spin tub opening, and has an opposing end portion disposed adjacent a drain hole in the cowling which is aligned with a radial space between the respective axially extending walls of the spin tub and the drain tub.

The nozzle comprises a delivery tube eccentrically disposed within an encircling drain tube of larger diametric size. The drain tube has a spout end portion secured about the target aperture, and has an open drain end portion disposed adjacent the drain hole in the cowling. The delivery tube has a frusto-conical end portion recessed axially within the spout end portion of the drain tube and provided with a sloped wall portion through which extends an output orifice aligned with the target aperture. An opposing input end portion of the delivery tube is connected through an hydraulic conduit to the pump which is connected hydraulically to a multi-load reservoir of liquid soap.

BRIEF DESCRIPTION OF THE DRAWINGS

For a better understanding of this invention, reference is made in the following detailed description to the accompanying drawings wherein.

DESCRIPTION OF THE PREFERRED EMBODIMENT

Figure 1:
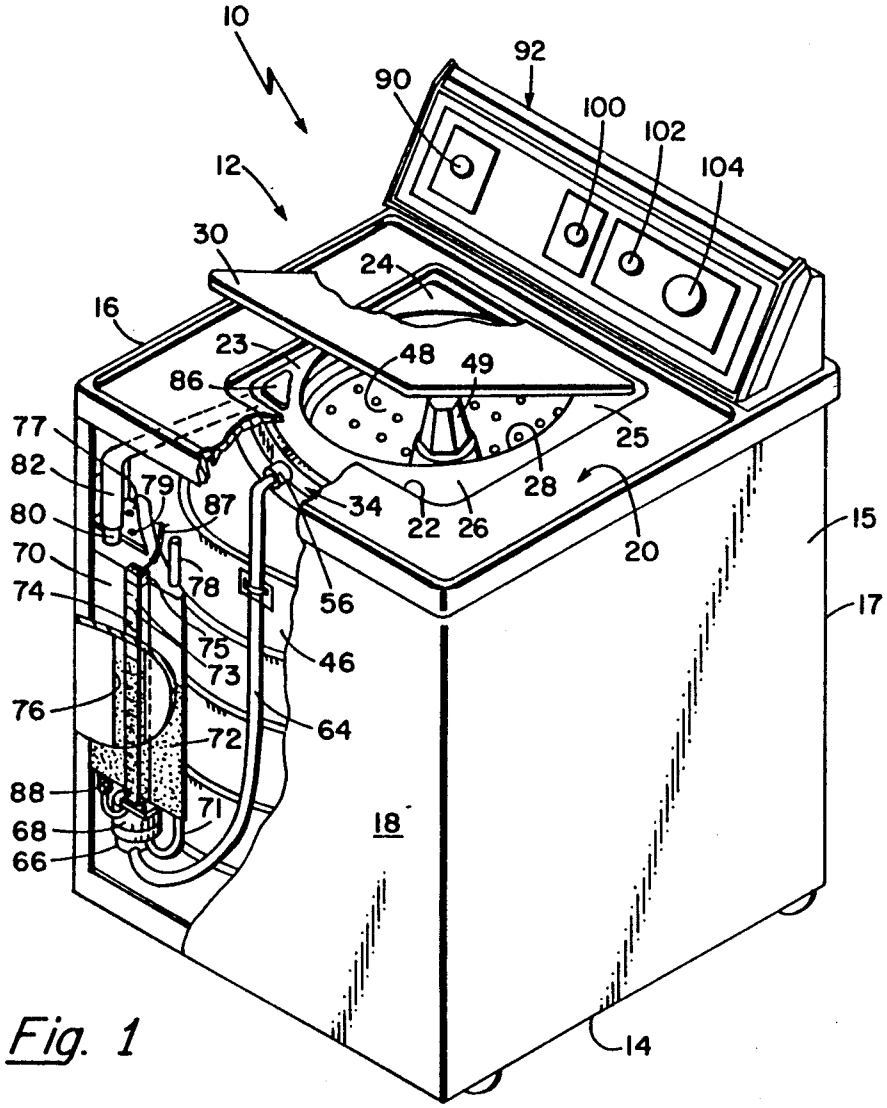
FIG. 1 is an isometric view, partly in section, of a clothes washing machine embodying the invention.

Referring to the drawings wherein like characters of reference designate like parts, there is shown in FIG. 1 an automatic clothes washing machine 10 of the vertical axis rotatable type having an upright cabinet 12 made of suitable metallic material, such as stainless steel sheet metal, for example. The cabinet 12 may be provided with a generally hexahedral configuration and a substantially rectangular cross-section. Cabinet 12 may include a base end wall 14, opposing side walls 15 and 16, respectively, a rear wall 17 and an opposing front wall 18. Also, the cabinet 12 is provided with a top or access end wall 20 having therein a generally rectangular recess 22 which includes four corner portions 23, 24, 25 and 26, respectively. The respective corner portions 23–26 aid in defining a circular clothes receiving opening 28 centrally disposed in the recess 22, and in supporting a hinged door 30 in a closed position within the recess 22. Door 30 may be moved pivotally to a fully open position when access to the clothes receiving opening 28 is required, such as when depositing clothes (not shown) in the clothes receiving opening 28 or when removing a wash load (not shown) from the machine 10, for example.

Figure 2:
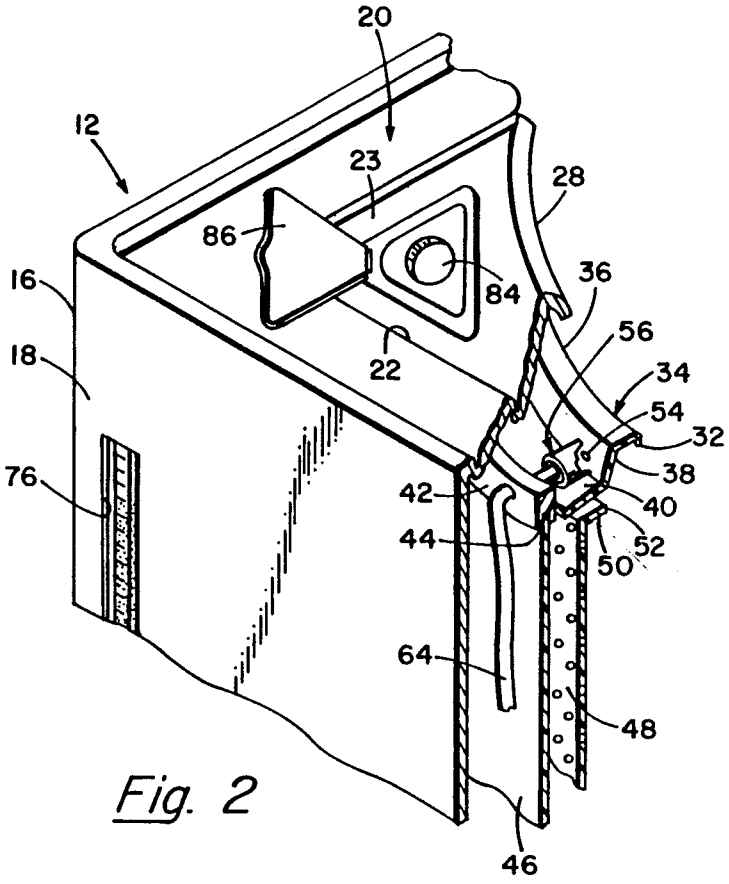
FIG. 2 is an enlarged fragmentary view of a portion of the washing machine shown in FIG. 1 and having therein the nozzle of this invention.

As shown more clearly in FIG. 2, the clothes receiving opening 28 is defined by an inner peripheral portion of access end wall 20 in recess 22 being curved axially inward of cabinet 12. This inner peripheral portion of access end wall 20 is encircled by a spaced lip 32 of an annular cowling 34 which is made of molded plastic material, such as a polycarbonate material, for example. The inner periphery of lip 32 defines a cowling opening 36 which has a diameter larger than the diameter of clothes receiving opening 28. Lip 32 has an outer peripheral portion which is integrally joined to a small diameter end of a frusto-conical element 38 of the cowling 34. Frusto-conical element 38 has a large diameter end portion integrally joined to an inner periphery of an annular channel element 40 of cowling 34. From its inner periphery, channel element 40 slopes radially at a divergent angle with the plane of access end wall 20, and terminates at its outer periphery in an integral flange element 42. The flange element 42 extends axially and comprises the outer peripheral portion of cowling 34.

Figure 4:
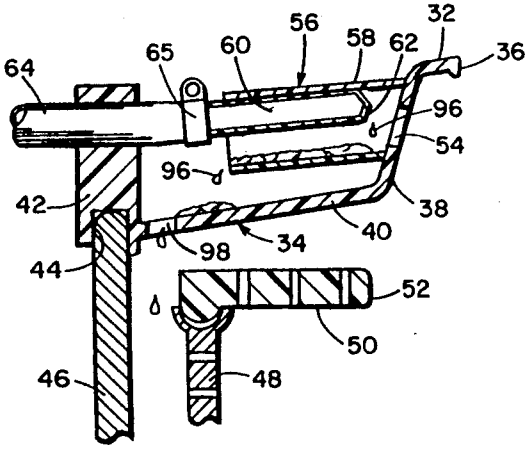
FIG. 4 is an enlarged schematic sectional view of the nozzle shown in FIG. 2 while directing excess droplets of additive liquid away from the spin tub.
Figure 3:
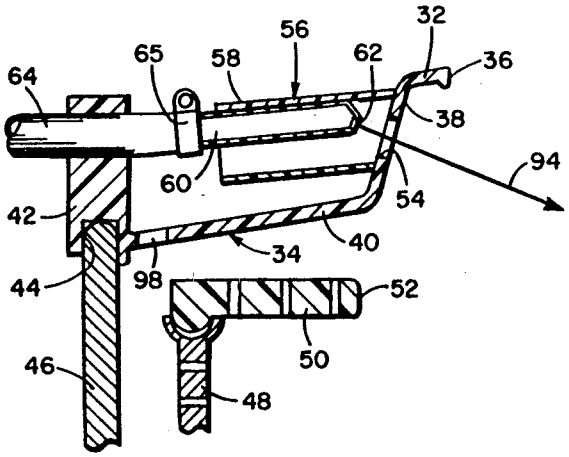
FIG. 3 is an enlarged schematic sectional view of the nozzle shown in FIG. 2 while directing a stream of additive liquid into the spin tub.

As shown more clearly in FIGS. 3 and 4, there is disposed in a lower end portion of flange element 42 an axially extending groove 44 wherein a circular rim portion of a stationary drain tub 46 is snugly received. Drain tub 46 is of the conventional type made of rigid material, such as stainless steel, for example. The circular rim portion of drain tub 46 defines an open end thereof disposed in a plane adjacent wall 20 and supports in cantilever fashion the annular cowling 34 which extends radially inward from the rim portion of drain tub 46. Also, the circular rim portion of drain tub 46 terminates an axially extending, imperforated wall thereof which is spaced radially outward of an axially extending, perforated wall of a spin tub 48.

The spin tub 48 is of the conventional type supported for axial rotation within the drain tub 46 and made of suitable material, such as porcellainized stainless steel, for example. Extending axially within the spin tub 48 is a conventional agitator post 49 which is disposed for rotation with the spin tub 48. Agitator post 49 has a distal end disposed adjacent an open end of the spin tub 48, which is defined by a bifurcated rim portion thereof. Pressed into the bifurcated rim portion of spin tub 48 is a dimpled under portion of a conventional spin tub collar 50 which may be perforated similar to the axially extending wall of spin tub 48. Collar 50 is made of suitable plastic material, such as a polycarbonate material, for example, and extends in cantilever fashion radially inward from the bifurcated rim portion of spin tub 48. The collar 50 has an inner periphery defining a collar opening 52 which has a diameter larger than the diameter of cowling opening 36 and is generally aligned therewith. Thus, when clothes (not shown) are deposited in the clothes receiving opening 28, they pass through the aligned cowling opening 36 and collar opening 52 to land in the spin tub 48 for processing by the machine 10.

The frusto-conical element 38 has extended through a portion thereof adjacent the front wall 18 of cabinet 12 a target aperture 54 through which a portion of the collar opening 52 may be viewed. Encircling the target aperture 54 is an outer surface portion of frusto-conical element 38 having attached thereto one end of a cylindrical nozzle 56 which is made of molded plastic material, such as a polycarbonate material, for example. The nozzle 56 extends in cantilever fashion outwardly from the frusto-conical element 38 and is supported in spaced relationship with the channel element 40 of cowling 34. Nozzle 56 comprises a drain tube component 58 having eccentrically disposed therein a longitudinally extending delivery tube component 60 with an outer diameter substantially smaller than the inner diameter of drain tube component 58. The drain tube component 58 has an open spout end which is attached, as by bonding with epoxy adhesive, for example, a surface portion of frusto-conical element 38 encircling target aperture 54. Also, the drain tube component 58 has an opposing drain end portion which is open and has extended longitudinally therein the smaller diameter delivery tube component 60.

The delivery tube component 60 is disposed longitudinally within the drain tube component 58 and is attached, as by bonding with epoxy adhesive, for example, to an inner surface portion of the drain tube component 58. As a result, the delivery tube component 60 is eccentrically disposed with respect to the axial centerline of drain tube component 58. Delivery tube component 60 has a spout end portion which is conically shaped and is recessed axially within the spout end portion of drain tube component 58. The spout end portion of delivery tube component 60 has extended through a sloped wall portion thereof aligned with target aperture 54 an outlet orifice 62 which is disposed for directing a stream of additive liquid through the target aperture 54. Delivery tube component 60 has an opposing input end portion extended longitudinally out of the drain end portion of the drain tube component 58 and connected hydraulically to an adjacent end portion of a flexible hose 64. The hose 64 is made of suitable material, such as polyethylene, for example, and is connected to the input portion of delivery tube component 60 in a conventional liquid-tight manner, such as by use of an encircling hose clamp 65, for example.

The flexible hose 64 extends downwardly within cabinet 12 and along the front wall 18 thereof to an end portion of hose 64 which is connected hydraulically to an output port of an additive pump 66 in a conventional liquid-tight manner. Pump 66 may be of the rotary vane type which is rotatably coupled to an additive motor 68, such as a pump and an alternating current motor combination sold by Sandek Charger Services of National Charger Service Center in Alexandria, VA, for example. The vane type pump 66 comprises a central hub having extending radially therefrom a circular array of angularly spaced vanes which are made of suitably rigid material, such as steel, for example. Pump 66 is supported by the motor 68 which is attached by suitable means to a lower plate-like end of an elongated reservoir housing 70. Preferably, the housing 70 is provided with a generally triangular cross-section for fitting conveniently in an elongated corner portion of cabinet 12 defined by a juncture of front and side walls, 18 and 16, respectively, of the cabinet. Housing 70 may be made as a single integral unit from soap resistant material, such as molded plastic material, for example, and has a hollow interior connected hydraulically through a flexible hose 71 to an input port of the pump 66. The housing 70 has a volumetric capacity for containing a multi-load quantity of liquid soap 72, such as one gallon or fifteen cups, for example, whereby successive loads of washing may be processed by the machine 10 over an extended period of time, such as one month, for example, without requiring refilling of the housing 70.

Adjacent the front wall of cabinet 12, the housing 70 has a side surface from which protrudes a colinear length of clear plastic tubing 74 having a generally rectangular cross-section. The tubing 74 is sealed to the adjacent side surface of housing 70 and communicates with the interior of housing 70 all along the length of tubing 74. Consequently, there is disposed in tubing 74 a column of the liquid soap 72 which indicates the level reached by the quantity of liquid soap 72 in housing 70. Disposed in the front wall 18 of cabinet 12 and aligned with the tubing 74 is a window 76 made of transparent material, such as clear plastic material, for example, whereby the level of soap 72 in housing 70 may be ascertained from externally of machine 10.

Also, the side of tubing 74 adjacent window 76 may be provided with a colinear series of uniformly spaced graduations 73 which correspond to respective cups of liquid soap 72 in the housing 70. Thus, the graduations 73 provide means for readily determining the total quantity of liquid soap 72 remaining in the housing 72. Moreover, the upper end surface of tubing 74 may have secured thereto in a conventional manner a light radiating means 75 which is connected electrically through a conductor cable 87 to a source of electrical power (not shown), such as a conventional alternating current source utilized for operating the washing machine 10, for example. The light radiating means 75 may comprise an inverted electrical socket (not shown) having therein an electrical lamp (not shown) which is disposed for directing light longitudinally down into the tubing 74. As a first alternative, the light radiating means 75 may comprise one or more light emitting diodes disposed to direct light down into the tubing 74. As a second alternative, the light radiating means 75 may comprise a tubular fluorescent light extending longitudinally parallel with the tubing 74. Furthermore, the opposing longitudinal sides of tubing 74 may be silvered to reflect light back onto the liquid soap 72 in tubing 74. Accordingly, the light radiating means 75 functions to illuminate the level of liquid soap 72 in tubing 74 so that the quantity of soap 72 remaining in housing 70 may be readily ascertained even in poorly illuminated environments.

The housing 70 includes an upper plate-like end which is attached by suitable means, such as right-angled plate 77 and screws 79, for example, to the side wall 16 of cabinet 12. Protruding from the upper end of housing 70 is a vent tube 78 which communicates with the interior of housing 70 for permitting egress and ingress of air as the level of liquid soap 72 increases and decreases, respectively, within housing 70. Also, the upper end of housing 70 has protruding therefrom a filler tube 80 which communicates with the interior of housing 70 and is connected hydraulically to one end portion of a filler hose 82. The filler hose 82 extends from the filler tube 80 upwardly within cabinet 12 and has its other end portion connected in a liquid-tight manner to a filler port 84 (FIG. 2). Filler port 84 is disposed in corner portion 23 of access end wall 20 within recess 22, and is provided with a protective cover 86 which is hinged. Thus, the cover 86 may be moved pivotally to a fully open position for pouring liquid soap 72 through the filler port 80 and filler hose 82 into the reservoir housing 70. Then, the cover 86 may be moved pivotally to a fully closed position where it may remain for the extended period of time, such as one month, for example, required to exhaust the contents of reservoir housing 70.

The additive motor 68 is connected through an electrical cable 88 to a soap dispensing control means comprised of a rotatable knob 90 protruding from a control panel 92 which extends upwardly from a marginal portion of access end wall 20 adjacent rear wall 17 of cabinet 12. Knob 90 may be maintained at a zero rotational position and pressed axially inward toward panel 92 for electrically energizing motor 68 and activating pump 66 as long as the knob 90 is pressed inwardly toward panel 92. Alternatively, the knob 90 may be rotated, such as ninety degrees from the zero rotational positions, for example, to select a predetermined quantity of additive liquid soap 72, such as one-quarter of a cup, for example. Then, the knob 90 may be pressed inwardly toward panel 92 and released to energize motor 68 and activate pump 66 for a predetermined length of time. In either instance, when the pump 66 is activated, liquid soap 72 is drawn from the reservoir housing 70 through hose 71 and forced through the hose 64 to the delivery tube component 60 of nozzle 56.

Figure 5:
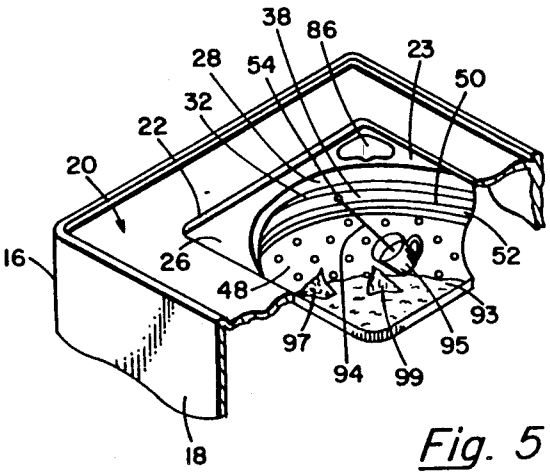
FIG. 5 is a fragmentary isometric view of the washing machine shown in FIG. 1; and during operation of the invention.

Consequently, as shown in FIG. 3, the pumped liquid soap 72 emerges from the outlet orifice 62 as a jet stream 94 which passes through the target aperture 54. As a result, the jet stream 94 of liquid soap is directed through the opening 52 of collar 50 and enters the spin tub 48. As shown in FIG. 5, a cup 95 may be held in the path of the jet stream 94 to determine if the quantity of liquid soap 72 being directed into spin tub 48 corresponds to the quantity of liquid soap 72 selected by adjustment of knob 90. Also, the liquid soap, thus obtained, may be examined regarding its quality and concentration for producing the desired effect on the wash water in spin tub 48. Preferably, the jet stream 94 entering spin tub 48 impinges on the agitator post 49 so that the liquid soap 72 in jet stream 94 will flow slowly down the post 49 and mix gradually with the wash water in spin tub 48. The stream 94 of liquid soap may be directed into spin tub 48 when wash water 93 is entering from drain tub 46 in the conventional manner and beginning to rise in the spin tub 48. Alternatively, the stream 94 of liquid soap may be directed into spin tub 48 when the wash water 93 has reached, or nearly reached, the required level in spin tub 48 for processing a wash load comprising items of clothing, such as 97 and 99, for examples, which have been passed through the clothes receiving opening 28 and are immersed in the wash water 93.

As shown in FIG. 4, when the motor 68 is de-energized and the pump 66 de-activated, the jet stream 94 no longer emerges from the outlet orifice 62. However, droplets 96 of liquid soap continue to accumulate at the outlet orifice 62 and fall into the drain tube component 58 of nozzle 56. Due to the slope of drain tube component 58, the droplets 96 run along the drain tube component 58 toward the drain end thereof which is adjacent the flange element 42 of cowling 34. As a result, the droplets 96 run out of the open drain end of drain tube component 58 and fall onto the underlying channel element 40 of cowling 34. Since the channel element 40 has a slope similar to the slope of drain tube component 58, the droplets 96 run radially downward of the channel element 40 to the junction thereof with the flange element 42 of cowling 34. Extended through a marginal portion of channel element 40 adjacent the flange element 42 is a plurality of arcuately spaced drain holes 98. Consequently, the drain holes 98 communicate with the radial space between the axially extending, imperforated wall of drain tub 46 and the axially extending perforated wall of spin tub 48. Accordingly, the droplets 96 pass through one or more of the drain holes 98 and fall into the wash water in the portion of drain tub 46 outside of the spin tub 48. Thus, the droplets 96 eventually mix with the portion of the wash water passing through the perforated wall of spin tub 48 and entering the spin tub 48.

Referring again to FIG. 1, the control panel 92 having protruding therefrom soap dispenser control knob 90 similarly may be provided with a water level control knob 100, a water temperature control knob 102, and a mode selector knob 104. The respective knobs 100, 102 and 104 electrically control the automatic operation of a plurality of components within cabinet 12 which are not shown since they do not affect the operation of the disclosed soap dispenser system. However, the mode selector knob 104 may be rotated to a position requiring the machine 10 to pass automatically through a pre-soaking operation prior to commencing a washing operation where injection of the liquid soap 72 into spin tub 48 is desired. Therefore, in order to retain automatic operation of the machine 10, it may be considered advantageous to incorporate electrical control of the soap dispenser system into the electrical control circuitry operated by the mode selector knob 104. Then, when the pre-soaking and subsequent water extraction operations are completed, the soap dispenser system will be activated simultaneously with the machine 10 commencing a washing operation. Thus, the disclosed soap dispenser system may be activated by manually pressing the knob 90 inwardly toward panel 92 or by automatically energizing the soap dispenser system electrically from the circuitry controlled via movement of the mode selector knob 104.

Figure 6:
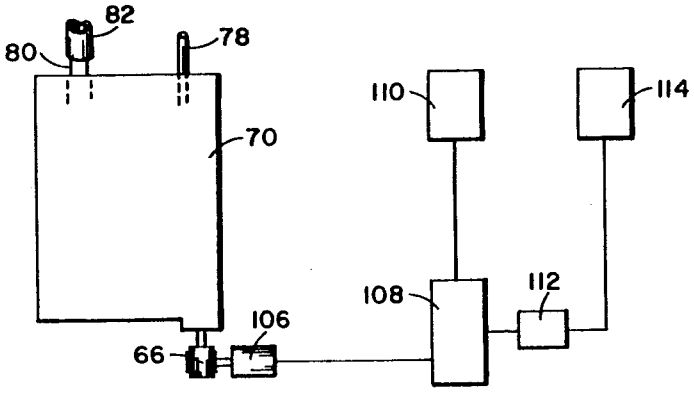
FIG. 6 is a schematic view of an alternative means for powering the additive liquid dispensing system shown in FIG. 1.

As shown in FIG. 6, the pump 66 instead of being coupled to the alternating current motor 68 shown in FIG. 1 may be coupled to a comparatively smaller direct current motor 106 which delivers an equivalent amount of power, such as thirty watts, for example, for forcing the liquid soap 72 through the outlet orifice 62. The direct current motor 106 may be especially designed for operating efficiently the pump 66 during the relatively short duty cycles, such as thirty seconds, for example, and life expectancy, such as forty hours, for example, expected of the motor. Direct current motors of this type may be found in battery powered tools, such as cordless drills and screwdrivers, for examples, which have similar torque requirements.

Pump 66 preferably is of the constant displacement type, such as a vane type having rigid vanes, for example, which forcefully expels liquid soap 72 from the nozzle 56 at a uniform rate. The direct current motor 106 is connected electrically to a control means comprising a conventional type of electrical timer circuit 108 and a dispenser amount selector unit 110. The selector unit 110 functions through the electrical timer circuit 108 to determine the length of time the motor 106 is energized thereby metering the amount of liquid soap 62 expelled from the nozzle 56. The electrical timer circuit 108, which generally includes integrated circuit devices (not shown) is energized, along with the direct current motor 68, from an electrically connected battery 112. Battery 112 is of the rechargeable type and is connected electrically to a trickle charge transformer 114 which may have its input connected electrically to the source of alternating current used for operating the washing machine 10.

Accordingly, there has been disclosed herein a soap dispenser means including reservoir housing 70 having an interior provided with a capacity for containing a multi-load quantity of liquid soap 72, and connected through pump 66 to the cylindrical nozzle 56. The nozzle 56 comprises delivery tube component 60 disposed longitudinally and eccentrically in outer drain tube component 58 which has an open spout end portion and an opposing open drain end portion. The delivery tube component 60 has an input end portion connected hydraulically to the pump 66 and has an opposing spout end portion which is conically shaped and recessed axially within the spout end portion of drain tube component 60. The spout end portion of delivery tube 60 has extended through a sloped wall portion thereof outlet orifice 62 which is disposed for directing the jet stream 94 of liquid soap from pump 66 out of the spout end portion of drain tube component 58.

The spout end portion of drain tube component 58 is secured in encircling relationship with the target aperture 54 in cowling 34 such that the drain tube component 58 slopes downwardly from its spout end portion to its drain end portion. Also, the drain tube component 58 extends radially over the annular channel element 40 of cowling 34 which has a slope in the radial direction similar to the slope of drain tube component 58. The jet stream 94 emerging from the spout end portion of drain tube component 58 is directed through the target aperture 54 in cowling 34 and into spin tub 48 of machine 10. The opening of spin tub 48 is aligned with a clothes receiving opening 28 of machine 10 which is encircled by the cowling 34. Consequently, the nozzle 56 which is supported on the cowling 34 outside the periphery of clothes receiving opening 28 does not snag or otherwise interfere with clothing passed through the clothes receiving aperture 28.

When the jet stream 94 ceases, any droplets 96 of liquid soap falling from the outlet orifice 62 land in the spout end portion of drain tube component 58. Due to gravity, the falling droplets 96 run down the slope of drain tube component 58 and out the open drain end portion thereof. Also, due to gravity, the droplets 96 landing on the channel element 40 run radially down the slope thereof and pass through one or more of the drain holes 98 to mix harmlessly with the wash water between the respective axially extending walls of drain tub 46 and spin tub 48. Thus, the disadvantage of having the droplets 96 of highly concentrated liquid soap landing on particular garments in a wash load during subsequent operations of machine 10 is overcome.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described herein is to be interpreted as illustrative and not in a limiting sense.

What is claimed is:

1. A clothes washing machine comprising:

a stationary drain tub having an imperofrated wall extended axially thereof and terminated in annular rim means of said drain tub for defining a drain tub open end of predetermined size and disposed in a plane;

a spin tub rotatably supported within said drain tub and having an axially extending perforated wall spaced radially from said imperforated wall of said drain tub, said perforated wall being terminated within said drain tub in rim means of said spin tub for defining a spin tub opening adjacent said drain tub open end and having a size smaller than said predetermined size;

annular cowling means having an outer peripheral portion secured to said rim means of said drain tub and extended therefrom in cantilever fashion over said rim means of said spin tub, said cowling means having an inner peripheral portion for defining a cowling opening aligned with said spin tub opening and having a size smaller than said size of said spin tub opening; and liquid soap dispensing means disposed adjacent said drain tub and externally thereof, said soap dispensing means including a cylindrical nozzle supported on said cowling means for directing a stream of liquid soap through said spin tub opening and into said spin tub.

2. A clothes washing machine as set forth in claim 1 wherein said cowling means includes an annular midportion sloped radially from said inner peripheral portion to said outer peripheral portion of said cowling means.

3. A clothes washing machine as set forth in claim 2 wherein said midportion includes an annular channel element having an inner peripheral portion connected to said inner peripheral portion of said cowling means and having an outer peripheral portion attached integrally to said outer peripheral portion of said cowling means, said annular channel element being extended from said inner peripheral portion thereof at a convergent radial slope with said plane of said drain tub open end.

4. A clothes washing machine as set forth in claim 3 wherein said nozzle extends radially over a portion of said annular channel element and is provided with a radially directed slope similar to said radial slope of said annular channel element, said nozzle having an output end portion disposed adjacent said inner peripheral portion of said channel element and having an input end portion disposed adjacent said outer peripheral portion of said channel element.

5. A clothes washing machine as set forth in claim 4 wherein said midportion includes a frusto-conical element having a large diameter end portion attached integrally to said inner peripheral portion of said annular channel element and having a smaller diameter end portion attached integrally to said inner peripheral portion of said cowling means, said frusto-conical element having a portion aligned with said output end portion of said nozzle and provided with aperture means for permitting passage of said stream of liquid soap through said cowling means and into said spin tub.

6. A clothes washing machine comprising:

an upright cabinet having an uppermost wall provided with a clothes receiving opening of predetermined size;

a stationary drain tub disposed within said cabinet and having an imperforated axially extending wall terminated in annular rim means of said drain tub for defining a drain tub open end disposed in a plane adjacent said uppermost wall and aligned with said clothes receiving opening;

a spin tub rotatable about a vertical axis within said drain tub and having a perforated axially extending wall spaced radially from said imperforated wall of said drain tub, said perforated wall being terminated within said drain tub in rim means of said spin tub for defining a spin tub opening aligned with said clothes receiving opening and having a size larger than said predetermined size;

annular cowling means having an outer periperal portion secured to said rim means of said drain tub and extended radially therefrom in cantilever fashion over said rim means of said spin tub, said cowling means having inner peripheral means encircling said clothes receiving opening for defining a cowling opening having a size smaller than said size of said spin tub opening and larger than said predetermined size; and liquid soap dispensing means disposed within said cabinet and externally of said drain tub, said soap dispensing means including a cylindrical nozzle supported on said cowling means in axially spaced relationship with said spin tub opening and in laterally spaced relationship with said clothes receiving opening for directing a stream of liquid soap through said spin tub opening and into said spin tub.

7. A clothes washing machine as set forth in claim 6 wherein said annular cowling means includes an annular midportion sloped downwardly in the radial direction from said inner peripheral portion to said outer peripheral portion of said cowling means.

8. A clothes washing machine as set forth in claim 7 wherein said cylindrical nozzle is extended radially over a portion of said annular midportion of said cowling means and has an output end portion disposed adjacent said inner peripheral portion of said cowling means, said nozzle having an opposing input end portion disposed adjacent said outer peripheral portion of said cowling means and being sloped downwardly from its input end portion to its output end portion.

9. A clothes washing machine as set forth in claim 8 wherein said nozzle includes a drain tube having a predetermined diametric size and having an open spout end portion comprising said output end portion of said nozzle, said drain tube having an open drain end portion disposed adjacent said outer peripheral portion of said cowling means and spaced radially inward therefrom.

10. A clothes washing machine as set forth in claim 9 wherein said nozzle includes a delivery tube having a diametric size substantially smaller than said predetermined diametric size and extended longitudinally in radially eccentric relationship within said drain tube, said delivery tube having a spout end portion recessed axially within said spout end portion of said drain tube and having an opposing input end portion extended longitudinally out of said open drain end portion of said drain tube, said input end portion of said delivery tube comprising said input end portion of said nozzle and being provided with means for receiving therein said stream of liquid soap.

11. A clothes washing machine as set forth in claim 10 wherein said spout end portion of said delivery tube is conically shaped and has extended through a sloped wall portion thereof outlet orifice means for directing said stream of liquid soap out of said open spout end portion of said drain tube.

12. A clothes washing machine as set forth in claim 11 wherein said midportion of said cowling means has aligned with said spout end portion of said drain tube aperture means for permitting passage of said stream of liquid soap through said cowling means and into said spin tub through said spin tub opening.

13. A washing machine comprising:

a cabinet including a defining wall provided with a wash load receiving opening having a predetermined size;

tub means including a rotatable spin tub within said wash load receiving opening, said spin tub having aligned with said wash load receiving opening a spin tub opening provided with a size larger than said predetermined size;

liquid soap dispensing means disposed in said cabinet and including a stationary nozzle supported in axially spaced relationship with said spin tub opening and in laterally spaced relationship with said wash load receiving opening for directing a stream of concentrated liquid soap into said spin tub through said spin tub opening; and an agitator including a post portion, said post portion being disposed in said rotatable spin tub wherein said directing means further comprises means for directing said stream of liquid soap to impinge on said post portion.

14. The clothes washing machine recited in claim 13 wherein said directing means comprises;

pumping means connected to said reservoir and said nozzle for forcing fluid from said reservoir in a stream through said nozzle.

15. A washing machine comprising:

a drain tub;

a rotable spin tub positioned within said drain tub for processing a wash load, said spin tub having a top opening;

a reservoir holding additive liquid;

means, coupled to said reservoir, for directing a stream of additive liquid from said reservoir in top said spin tub at an angle through said top opening, said directing means comprising a nozzle positioned above said spin tub; and means positioned directly below said nozzle out of the way of said stream of additive liquid for preventing said additive liquid from dripping from said nozzle into said spin tub.

16. The washing machine recited in claim 15 wherein said preventing means comprises means for channeling dripped additive liquid from said nozzle to a region external to said spin tub.

* * * * *